US006095328A

United States Patent [19]

Smithbaker, III et al.

[11] Patent Number: 6,095,328

[45] Date of Patent: Aug. 1, 2000

[54] CARRYING CASE FOR BINOCULARS

[75] Inventors: John J. Smithbaker, III, Lander; Jon T. Cox; Brendon S. Weaver, both of Riverton, all of Wyo.

[73] Assignee: The Brunton Company, Riverton, Wyo.

[21] Appl. No.: 09/231,842

[22] Filed: Jan. 14, 1999

[51] Int. Cl.[7] ..... B65D 85/38

[52] U.S. Cl. ..... 206/316.3; 206/316.1

[58] Field of Search ..... 206/316.1, 316.2, 206/316.3, 579; 224/908, 909; 359/480, 481, 482, 375, 407

[56] References Cited

U.S. PATENT DOCUMENTS

| | | | |
|---|---|---|---|
| D. 271,540 | 11/1983 | Williams . | |
| 2,372,479 | 3/1945 | French | 206/316.3 |
| 2,813,564 | 11/1957 | Benz | 206/316.3 |
| 3,782,614 | 1/1974 | Campisi | 224/909 |
| 3,813,017 | 5/1974 | Pimsleur . | |
| 4,142,566 | 3/1979 | Stolp . | |
| 4,232,808 | 11/1980 | Gray | 206/316.3 |
| 5,320,261 | 6/1994 | Andersen | 224/909 |

FOREIGN PATENT DOCUMENTS

| | | | |
|---|---|---|---|
| 805190 | 12/1958 | United Kingdom | 206/316.3 |

*Primary Examiner*—Paul T. Sewell
*Assistant Examiner*—Luan K. Bui
*Attorney, Agent, or Firm*—John E. Reilly

[57] ABSTRACT

A carrying case for binoculars which protects the binoculars during use without interfering with the user's operation of the binoculars. The carrying case comprises a tubular-shaped main body formed from a stretchable and resilient material which is normally undersized in relation to the binoculars, whereby the main body undergoes expansion upon insertion of the binoculars and surrounds the binoculars in snug-fitting relation. The main body has openings at opposite ends thereof for exposing the lenses of the binoculars during use, and an aperture for exposing a focus adjustment member during use. Each of the openings and the aperture contains removable closures for protecting the lenses and the focus adjustment member when the binoculars are not in use. Further, the resilient material of the main body facilitates the gripping and holding of the binoculars while in use.

19 Claims, 1 Drawing Sheet

CARRYING CASE FOR BINOCULARS

BACKGROUND AND FIELD OF THE INVENTION

This invention relates to carrying cases for instruments; and more particularly relates to a novel and improved binocular carrying case which protects the binoculars while they are being used as well as when they are in storage.

It is well known to provide a protective carrying case for optical instruments to prevent them from being damaged while not in use. For example, U.S. Pat. No. Des. 271,540, issued to Williams, discloses a design for a binocular case; U.S. Pat. No. 3,813,017, issued to Pimsleur, discloses a carrying case formed from flexible material for camera storage; and U.S. Pat. No. 4,142,566, issued to Stolp, discloses a binocular case having a hinged supporting tray and wall for opening and closing the case.

However, there has been little in regard to protective, form-fitting carrying cases for optical instruments which have the additional feature of allowing use and improved gripping of the optical instruments while they remain enclosed within the case. It is preferable for many types of optical instruments, e.g. binoculars, to remain in the carrying case to provide additional protection when they are in use. Further, in the case of binoculars, during use the optic and objective lenses must be free from obstructions and the user must also have ready access to the focus adjustment members of the binoculars. Although the Williams patent discloses two openings in the case for the optic and objective lenses, the case obstructs the focus adjustment member of the binoculars. Thus, a user would have to remove the binoculars from the case for every focus adjustment.

Yet another problem with traditional binocular cases is their bulky size and shape which makes it difficult for a person to use the binoculars while they are enclosed within the carrying case.

It is therefore desirable to provide a snug-fitting binocular carrying case which is user-friendly, easy to grip, and does not interfere with the use of the binoculars. Specifically, the novel and improved carrying case does not obstruct the lenses or prevent access to the focus adjustment members of the binoculars, when in the case, and is composed of a material that is form-fitting and can be grasped to minimize slipping.

Further, the carrying case would be of a manageable shape and size so that it would not interfere with the use and operation of the binoculars when they are enclosed within the carrying case.

SUMMARY OF THE INVENTION

It is therefore an object of the present invention to provide for a novel and improved protective carrying case for optical instruments, and is specifically adapted for binoculars, which provides access to the lenses and the focus adjustment members of the binoculars such that a person may use the binoculars while they remain enclosed within the carrying case but will fully protect and enclose the instruments when not in use.

It is another object of the present invention to provide a novel and improved carrying case for optical instruments which provides protection for the instrument without the bulky size and shape associated with traditional carrying cases so that the case does not interfere with the use and operation of the optical instrument.

In accordance with the present invention, a novel and improved carrying case for use with an instrument having at least one adjustment member, such as, a set of binoculars, includes a generally tubular main body which houses the binoculars. The main body forms openings with removable closures at opposite ends thereof for exposing the lenses of the binoculars. The main body additionally contains at least one aperture which affords access to a focus adjustment member. In this way, a user may view objects through the lenses of the binoculars and make focus adjustments while the binoculars remain enclosed within the protective carrying case.

The main body is normally undersized in relation to the size of the binoculars and is formed from a stretchable material which is flexible, resilient, and facilitates grasping or secure holding of the binoculars. The main body therefore must undergo expansion during insertion of the binoculars in order to house the binoculars in snug-fitting surrounding relation upon insertion of the binoculars in the carrying case. The reduced size of the carrying case and the snug-fitting relation with respect to the binoculars eliminates interference of the carrying case with the use and operation of the binoculars while they are inside the carrying case.

The novel and improved carrying case for optical instruments is not limited to use with binoculars, but may be modified for use with other types of instruments and especially optical instruments adapted for use in the field, including, but not limited to, telescopes, cameras, distance scopes, and monoculars.

The above and other objects of the present invention will become more readily appreciated and understood from a consideration of the following detailed description of preferred and modified forms of the present invention when taken together with the accompanying drawings in which:

DETAILED DESCRIPTION OF A PREFERRED EMBODIMENT

Figure 1:
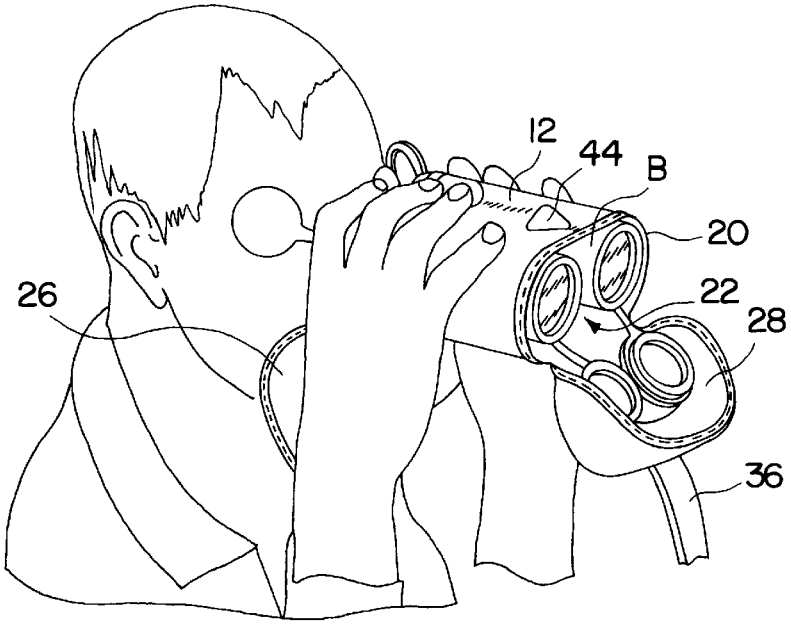
FIG. 1 is a perspective view of the preferred form of the binocular carrying case being used in conjunction with the operation of a set of binoculars.

Referring in more detail to the drawings, as shown in FIGS. 1–6, a preferred embodiment of the present invention is described. In this particular preferred embodiment a novel and improved binocular carrying case is illustrated. It is to be clearly understood that this preferred embodiment is provided for descriptive purposes only and is not meant to unduly limit the scope of the inventive concept. Other embodiments and applications are included within the inventive concept as set forth.

Referring to FIGS. 1–6, the binocular carrying case includes a sleeve-like main body 10 which is adapted to house a pair of binoculars B having at least one focus adjustment member F, such as, a focus wheel. The main body 10 is composed of a stretchable material, which is flexible and resilient, such as, a closed cell neoprene, LYCRA®, or SPANDEX®. This stretchable material may be textured at least on an outer surface thereby making it easier to grip and reducing slipping of the binoculars while in a user's hands. The main body 10 is of a uniform opening size, or diameter, throughout its length and is normally undersized in relation to the size of the binoculars B such that the size of the main body 10 expands upon insertion of the binoculars B into the main body 10. The reduced size of the main body 10 in conjunction with the stretchable material causes the main body 10 to house the binoculars B in snug-fitting surrounding relation.

The main body 10 includes an upper wall 12, a lower wall 14 opposite to the upper wall 12, a front end 16, and a rear end 20 opposite to the front end 16. The front end 16 forms a front opening 18 which exposes ocular lenses of the binoculars B when they are enclosed within the main body 10; the rear end 20 forms a rear opening 22 which exposes objective lenses of the binoculars B when they are enclosed within the main body 10.

The upper wall 12 includes at least one focus adjustment aperture 24 which exposes the focus wheel F. In this way, a user may make focus adjustments while the binoculars B remain enclosed within the main body 10.

Figure 3:
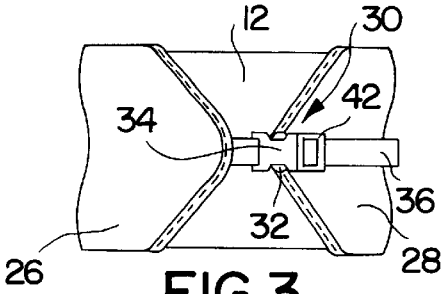
FIG. 3 is a top plan view of the preferred form with the front and rear flaps shown in a closed position.
Figure 4:
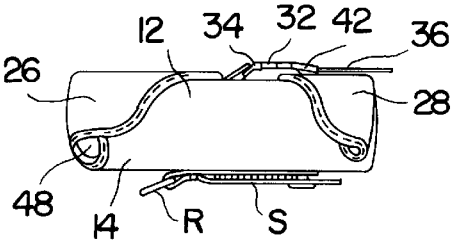
FIG. 4 is a side elevation view of the preferred form with the front and rear flaps in a closed position.

A front flap 26 is hinged to the lower wall 14 at a location adjacent to the front opening 18. The front flap 26 is composed of the same stretchable material as the main body 10 which permits movement of the front flap 26 from a closed position when the binoculars B are not in use, to an open position when the binoculars B are being used. As shown in FIG. 3, when in the closed position, the front flap 26 covers the front opening 18 and the focus adjustment aperture 24 thereby protecting the ocular lenses and the focus wheel F. As shown in FIG. 1, when in an open position, the front flap 26 is adjacent to the lower wall 14 thereby exposing the ocular lenses and the focus wheel F.

A rear flap 28 is hinged to the lower wall 14 at a location adjacent to the rear opening 22. The rear flap 28 is composed of the same stretchable material as the main body 10 which permits movement of the rear flap 28 from a closed position when the binoculars B are not in use to an open position when the binoculars B are being used. As shown in FIG. 3, when in a closed position, the rear flap 28 covers the rear opening 22. As shown in FIG. 1, when in an open position, the rear flap 28 does not obstruct the objective lenses of the binoculars B.

The stretchable material from which the main body 10, the front flap 26, and the rear flap 28 is composed is at least stretchable in a circumferential direction, or two-way stretchable, to facilitate the insertion of the binoculars B into the main body 10. However, the stretchable material may also be stretchable in a longitudinal direction, or four-way stretchable, to facilitate both the insertion of the binoculars into the main body 10, as well as, the closing of the front and rear flaps 26 and 28. Also, the four-way stretchable material enables the front flap 26 to completely cover the focus adjustment aperture 24 when the front flap 26 is in a closed position, and enables either end of the main body 10 to be folded upon itself for exposing additional focus adjustment members located on either the front or rear ends of the binoculars.

Fastening means, such as, a buckle connector 30 secures the front flap 26 and the rear flap 28 in the closed position when the binoculars B are not in use. The buckle connector 30 includes a buckle 32, a buckle-receiving end 34, and a strap 36. The buckle 32 is attached to a first end 38 of the strap 36. A second end 40 of the strap 36 is attached to the lower wall 14 of the main body 10 adjacent to the hinged connection between the rear flap 28 and the main body 10. The buckle-receiving end 34 is attached to the front flap 26 opposite to the hinged connection between the front flap 26 and the main body 10. The buckle 32 is connected to the buckle-receiving end 34 thereby temporarily securing the front flap 26 and the rear flap 28 in a closed position. The strap 36 may contain an adjustment device 42 for tightening the closed position when the strap 36 is shortened and loosening the connection when the strap 36 is lengthened.

Figure 2:
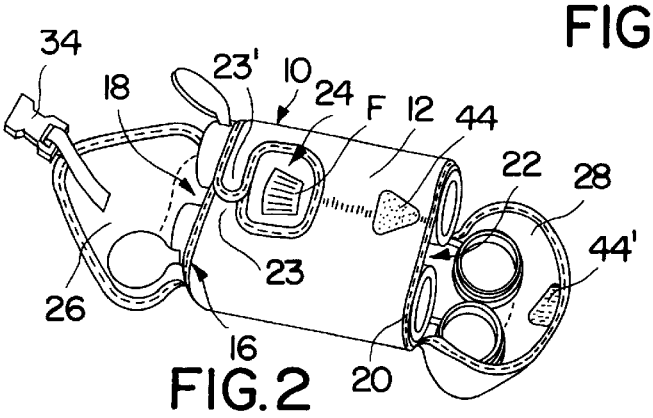
FIG. 2 is top plan view of an alternate embodiment of the binocular carrying case with the front and rear flaps shown in an open position.
Figure 5:
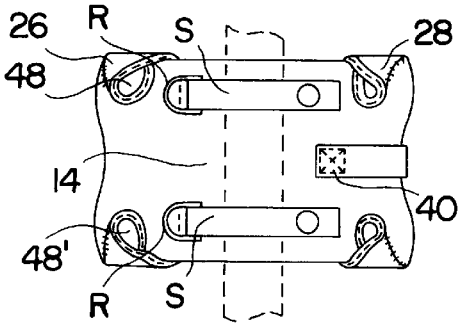
FIG. 5 is a bottom plan view of the preferred form with the front and rear flaps in a closed position.

Alteratively or collectively, the fastening means may consist of mating adhesive devices 44 and 44', such as, a snap connector or a strip of VELCRO®. For example, as shown in FIGS. 2 and 5, the adhesive strip 44 is attached to the upper wall 12 of the main body 10 adjacent to the rear opening 22. The adhesive strip 44' is attached to an inner surface of the rear flap 28. When the adhesive strips 44 and 44' mate, they form a releasable connection which secures the rear flap 28 in the closed position.

Figure 6:
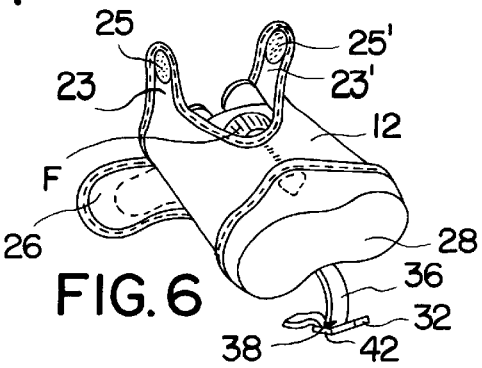
FIG. 6 is a perspective view of the alternate embodiment shown in FIG. 2 with the front flap open and the focus flaps open.

FIGS. 2 and 6 show an alternative embodiment of the present invention, in which the main body 10 forms a pair of opposed branches 23 and 23' located in between the front opening 18 and the focus adjustment aperture 24. As shown in FIG. 2, the branches 23 and 23' are of equal length and long enough to overlap one another. The branch 23 includes a mating adhesive portion 25, such as, a snap connector or a strip of VELCRO®, on its outer surface; the branch 23' includes a complementary mating adhesive portion 25' to the adhesive portion 25 located on an inner surface of the branch 23'. The mating of adhesive portions 25 and 25 secure the connection between the branches 23 and 23'. As shown in FIG. 6, when the connection between the branches 23 and 23' is released, the front opening 18 meshes with the focus adjustment aperture 24 forming one large opening which loosens the snug-fit of the main body 10 in surrounding relation to the binoculars B. In this way, it is easier to remove the binoculars B from their enclosure within the main body 10.

As shown in FIG. 5, it is well known to provide belt straps S and/or strap connecting rings R directly attached to the main body 10 so that the carrying case may be supported by a belt, shoulder strap, or neck strap. In a further embodiment of the present invention, a shoulder strap or neck strap may be connected directly to the binoculars B while they are enclosed within the main body 10. The front flap 26 does not completely cover the front opening 18 thereby forming two slots 48 and 48 when the front flap 26 is in a closed position. The slots 48 and 48' are located on each side of the hinged connection between the front flap 26 and the main body 10 on the lower wall 14. In this way, when the front flap 26 is closed, the neck strap attached to the binoculars B extends from inside the main body 10 through the slots 48 and 48' to the outside of the main body 10. Also, the front flap may be opened and closed without interfering with the placement of the neck strap.

Accordingly, the front opening 18, the rear opening 22, and the focus adjustment aperture give a user access to all of instruments necessary for operation of the binoculars B thereby permitting use of the binoculars B while they remain enclosed within the carrying case. When the binoculars B are not in use, the front flap 26 and the rear flap 28 protect the ocular and objective lenses as well as the focus wheel. The snug-fitting surrounding relation of the main body 10 in relation to the binoculars B reduces interference of the carrying case with the use and operation of the binoculars B.

Finally, the stretchable and resilient material of the main body 10, the front flap 26, and the rear flap 28 makes it easy for the user to maintain a firm grasp on the binoculars B while in use.

It is therefore to be understood that the above and other modifications and changes may be made in the binocular carrying case of the present invention without departing from the spirit and scope of the invention as defined by the appended claims.

We claim:

1. A carrying case in combination with an optical instrument, said optical instrument having at least one focus adjustment member thereon and said case includes a main body for housing said instrument, said main body having a generally tubular shape with openings at opposite ends thereof for exposing the lenses of said instrument, said main body being normally undersized in relation to the size of said instrument and being formed from a stretchable material wherein said main body will undergo expansion into snug-fitting surrounding relation to said instrument when said instrument is inserted therein and does not interfere with the use and operation of said instrument;

said main body being provided with an aperture for exposing each said focus adjustment member thereby providing access to said focus adjustment member when said instrument is enclosed in said carrying case; and a front flap attached to said main body at a location adjacent to one of said openings, said front flap covering said opening and said focus adjustment aperture when said front flap is in a closed position; a rear flap attached to said main body at a location adjacent to another of said openings, said rear flap covering said other opening when said rear flap is in a closed position; and fastening means for securing each of said front flap and said rear flap in said closed position.

2. In a carrying case for binoculars having at least one focus adjustment member thereon wherein said case includes a main body for housing said binoculars, the improvement comprising:

said main body having a generally tubular shape with openings at opposite ends thereof for exposing the lenses of said binoculars, said main body being formed from a stretchable material wherein said main body will undergo expansion into snug-fitting surrounding relation to said binoculars when said binoculars are inserted therein and does not interfere with the use and operation of said binoculars;

said main body provided with an aperture for exposing each said focus adjustment member thereby providing access to said focus adjustment member when said binoculars are enclosed in said carrying case; and a front flap attached to said main body at a location adjacent to one of said openings, said front flap covering said opening and said focus adjustment aperture when said front flap is in a closed position; a rear flap attached to said main body at a location adjacent to another of said openings, said rear flap covering said other opening when said rear flap is in a closed position; and fastening means for securing each of said front flap and said rear flap in said closed position.

3. In the binocular carrying case of claim 2 wherein:

said stretchable material is stretchable circumferentially for allowing insertion of said binoculars into said normally undersized main body.

4. In the binocular carrying case of claim 2 wherein:

said stretchable material is textured for making said carrying case easier to grip for a user.

5. In the binocular carrying case of claim 2 further including:

a pair of opposed branches formed from said main body being located between one of said openings and said focus adjustment aperture, each of said opposed branches being of equal length and long enough to overlap one another, and each of said opposed branches containing a mating adhesive devise for securing a releasable connection between said opposed branches.

6. In the binocular carrying case of claim 2 wherein:

said front flap and said rear flap are formed from the same stretchable material as said main body.

7. In the binocular carrying case of claim 6 wherein:

said stretchable material is stretchable circumferentially for insertion of said binoculars into said normally undersized main body and stretchable longitudinally for expansion of said front flap to completely cover said focus adjustment aperture when said front flap is in a closed position.

8. In the binocular carrying case of claim 2 wherein:

said fastening means comprises a buckle connector.

9. In the binocular carrying case of claim 2 wherein said fastening means comprises:

a mating adhesive device attached to said main body adjacent to at least one of said openings; and a complementary mating adhesive device attached to at least one of said flaps whereby said mating adhesive device connects with said complementary mating adhesive device for securing said flap in said closed position.

10. In the binocular carrying case of claim 9 wherein:

said mating adhesive device and said complementary mating adhesive device consist of strips of VELCRO®.

11. In the binocular carrying case of claim 9 wherein:

said mating adhesive device and said complementary mating adhesive device consist of a snap connector.

12. A binocular carrying case for binoculars having a focus wheel thereon comprising:

a sleeve-like main body composed of a stretchable material for surrounding a set of binoculars, said main body having an upper wall, a lower wall opposite to said upper wall, a front end, and a rear end opposite to said front end, said front end forming a front opening for exposure of optic lenses of said binoculars, said rear end forming a rear opening for exposure of objective lenses of said binoculars;

said upper wall of said main body provided with a focus wheel aperture for exposing said focus wheel for focus adjustment when said binoculars are enclosed in said carrying case;

a front flap being hinged to said lower wall of said main body adjacent to said front opening for movement from a closed position in which said front flap covers said front opening and said focus wheel aperture for protection when said binoculars are not in use, to an open position in which said front flap is adjacent to said lower wall of said main body thereby exposing said optic lenses and said focus wheel when said binoculars are being used;

a rear flap being hinged to said lower wall of said main body adjacent to said rear opening for movement of said rear flap from a closed position in which said rear flap covers said rear opening when said binoculars are not in use, to an open position in which said rear opening is not obstructed by said rear flap thereby exposing said objective lenses when said binoculars are being used; and a buckle connector attached to said front and rear flaps for securing said front and rear flaps together in said closed position.

13. The binocular carrying case of claim 12 wherein said main body further includes:

a pair of opposed branches formed from said main body being located between one of said front opening and said focus adjustment aperture, each of said opposed branches being of equal length and long enough to overlap one another, and each of said opposed branches containing a mating adhesive portion for effecting a releasable connection between said opposed branches.

14. The binocular carrying case of claim 13 wherein:

said mating adhesive portion is a snap connector.

15. The binocular carrying case of claim 13 wherein:

said mating adhesive portion is a strip of VELCRO®.

16. The binocular carrying case of claim 12 wherein said buckle connecter includes:

a strap having a first and second end, said second end being attached to said lower wall of said main body adjacent to said hinged connection between said rear flap and said main body;

a buckle attached to said first end of said strap; and a buckle-receiving end attached to said front flap opposite to said hinged connection between said front flap and said main body, whereby said buckle connects to said buckle-receiving end for securing said front flap and said rear flap in said closed position.

17. The binocular carrying case of claim 16 wherein:

said strap is adjustable for tightening said closed position of said front and rear flaps when said strap is shortened and loosening said closed position when said strap is lengthened.

18. The binocular carrying case of claim 12 further including:

a pair of slots being located on either side of said hinged connection between said front flap and said main body on said lower wall of said main body for egress of a neck strap connected to said binoculars while they are enclosed within said carrying case.

19. In a carrying case for binoculars having at least one focus adjustment member thereon wherein said case includes a main body for housing said binoculars, the improvement comprising:

said main body having a generally tubular shape with openings at opposite ends thereof for exposing the lenses of said binoculars, said main body being formed from a stretchable material wherein said main body will undergo expansion into snug-fitting surrounding relation to said binoculars when said binoculars are inserted therein and does not interfere with the use and operation of said binoculars;

said main body provided with an aperture for exposing each said focus adjustment member thereby providing access to said focus adjustment member when said binoculars are enclosed in said carrying case; and a pair of opposed branches formed from said main body being located between one of said openings and said focus adjustment aperture, each of said opposed branches being of equal length and long enough to overlap one another, and each of said opposed branches containing a mating adhesive device for securing a releasable connection between said opposed branches.

* * * * *